US005377300A

United States Patent [19]

Collins et al.

[11] Patent Number: 5,377,300

[45] Date of Patent: Dec. 27, 1994

[54] HEATER FOR PROCESSING GASES

[75] Inventors: Craig C. Collins; Eric A. Ahlstrom, both of Santa Cruz, Calif.

[73] Assignee: Watkins-Johnson Company, Palo Alto, Calif.

[21] Appl. No.: 971,490

[22] Filed: Nov. 4, 1992

[51] Int. Cl.[5] ..... F24H 1/10; F24H 1/14

[52] U.S. Cl. ..... 392/479; 392/480; 392/484; 392/491

[58] Field of Search ..... 392/479, 465, 491, 485, 392/492, 493, 480, 481

[56] References Cited

U.S. PATENT DOCUMENTS

| | | | |
|---|---|---|---|
| 3,338,476 | 4/1967 | Marcoux | 392/479 |
| 3,666,918 | 5/1972 | Clark, Jr. et al. | 219/314 |
| 3,968,346 | 7/1976 | Cooksley | 219/305 |
| 4,709,135 | 11/1987 | Dietrich et al. | 219/303 |
| 5,206,928 | 4/1993 | Spörri | 392/491 |

*Primary Examiner*—Mark H. Paschall

*Attorney, Agent, or Firm*—Flehr, Hohbach, Test, Albritton & Herbert

[57] ABSTRACT

A heater for heating processing gases used in semiconductor processing equipment; the heater including a chamber whose walls are heated by a strip heater whereby gases flowing through the chamber are heated by said heated walls.

8 Claims, 1 Drawing Sheet

HEATER FOR PROCESSING GASES

BRIEF DESCRIPTION OF THE INVENTION

This invention relates generally to a gas heater for processing gases, and more particularly to a heater for heating processing gases in delivery lines which deliver process vapors and gases to reaction chambers in semiconductor processing equipment.

BACKGROUND OF THE INVENTION

Manufacturing processes for fabricating semiconductor devices and integrated circuits require the use of chemicals in a gas form with their temperatures precisely controlled. Generally, the gas is generated in a source such as a bubbler in which a carrier gas is bubbled through a liquid chemical to provide a vapor which is mixed with the carrier gas. The temperature of the mixture must be controlled to prevent condensation of the vapor before it reaches the reaction chamber. In some prior art equipment, heating is accomplished by using the delivery lines as a distributed heating element; that is, by passing electrical current through the line to provide resistance heating of the line. There are problems with such heating systems. They require large transformers to supply the necessary heating current. The heated delivery line section must be electrically isolated from the remainder of the equipment. Such couplings introduce a variety of problems, including the introduction of contaminants. The temperature is difficult to control dynamically because of the heat storage capacity of the lines, because the temperature of the gas is not directly measured, and because there is low heat transfer between the lines and the gas.

OBJECTS AND SUMMARY OF THE INVENTION

It is a general object of this invention to provide an improved heater for heating processing gases used in semiconductor circuit processing equipment.

It is a further object of this invention to provide a heater for heating processing gases in semiconductor processing equipment safely and without the introduction of impurities.

It is still a further object of this invention to provide a heater for controllably heating processing gases.

It is a further object of this invention to provide a heater which efficiently heats processing gases over a wide range of gas flow.

It is a further object of this invention to provide a gas heater in which the gas temperature control is independent of gas flow rates.

It is a further object of this invention to provide a gas heater in which the temperature of the processing gases is directly measured for better control and accuracy.

The foregoing and other objects of the invention are achieved by a gas heater which includes a heating chamber having heated walls in which the gas flow velocity decreases because of the chamber volume and this, in turn, increases the heat exchange with the heated walls to efficiently heat the processing gas. The heater additionally may include a thermocouple and control system whereby the temperature of the processing gas can be controlled by controlling the chamber temperature.

BRIEF DESCRIPTION OF THE DRAWINGS

The accompanying drawings, which are incorporated in and form part of the specification, illustrate an embodiment of the invention and, together with the description, serve to describe the invention.

DESCRIPTION OF THE PREFERRED EMBODIMENT

Reference will now be made in detail to the preferred embodiment of the invention, which is illustrated in the accompanying drawings. While the invention will be described in conjunction with the preferred embodiment, it will be understood that it is not intended to limit the invention to this embodiment. On the contrary, the invention is intended to cover alternatives, modifications and equivalents, which may be included within the spirit and scope of the invention as defined by the appended claims.

Figure 1:
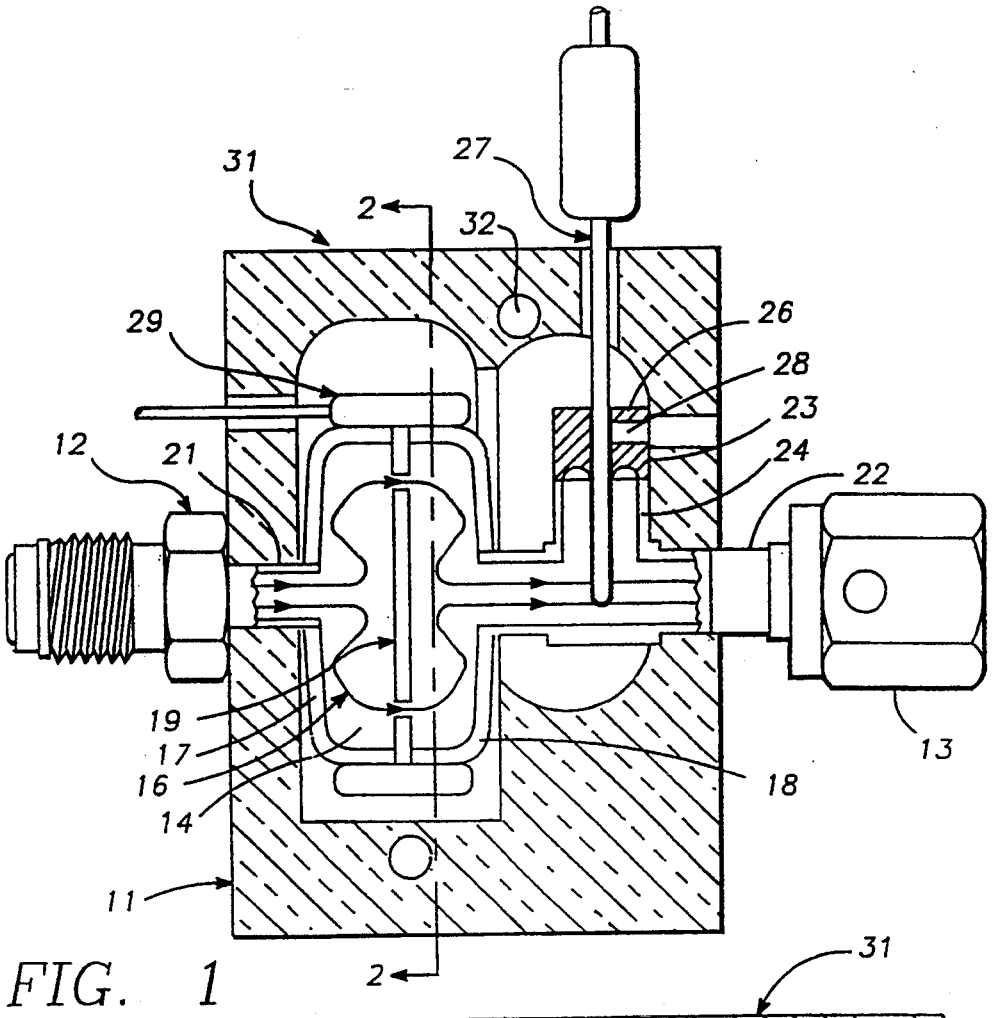
FIG. 1 is a sectional view of a gas heater taken along the line 1—1 of FIG. 2.
Figure 2:
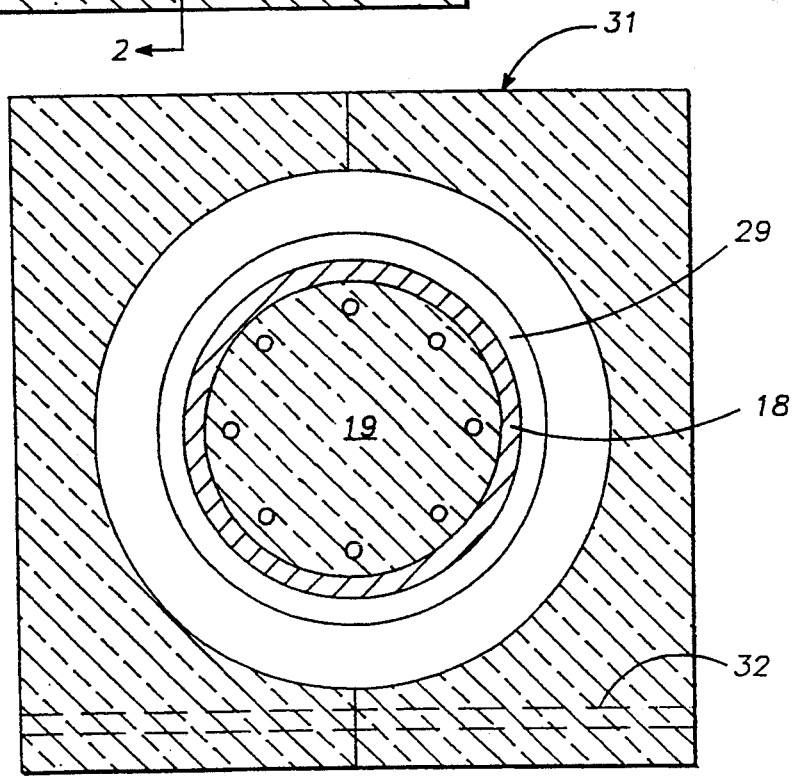
FIG. 2 is a sectional view of a gas heater taken along the line 2—2 of FIG. 1.

The heater is illustrated in FIGS. 1 and 2. It includes processing gas fittings for connection into processing supply lines of semiconductor processing apparatus. As shown, heater 11 includes an inlet coupling 12 and an outlet coupling 13. The chemical processing gas flows through and has its temperature maintained by the heater 11. The heater comprises a chamber 14 into which the gas flows as illustrated by the flow lines 16. The chamber includes two end caps 17A and 18A which are welded to a diversion plate 19. The diversion plate diverts the flow of gas to increase heat transfer from the adjacent chamber walls 17 and 18, whereby the heat exchange is increased between the gas and the adjacent walls 17 and 18. The end cap 17A is welded to the tubing 21 attached to the fitting 12. The end cap 18A is welded to the tubing 22 which is attached to the fitting 13. A fitting 23 comprising a tubular portion 24 and end sealing portion 26 is welded to the tubing 22 and is adapted to receive a thermocouple 27 which can be secured in place by a set screw 28. The welds are full penetration welds whereby there are no dead spaces where contaminants can collect. Preferably, the internal surfaces of the chamber are electropolished. The walls 17 and 18 of the chamber 14 are heated by a strip heater 29.

The heater assembly is housed in a two-piece insulating housing 31 which may be made of ceramic or other insulating material. As seen, the housing is held by the means of fastening screws which extend through the holes 52. The heating element, temperature sensor, heater and housing can be replaced without disturbing the process plumbing by loosening the screws and removing the insulating housing, thereby providing access to the heater and thermocouple.

In operation, processing gases enter the heating chamber where the velocity decreases due to the increase in volume. The diversion plate creates a turbulent flow and increases heat exchange with the heated surface area. Thus, the gas is efficiently heated. The thermocouple measures the gas temperature directly as it leaves the heater. This allows the heater to form part of a control system for controlling the power applied to the strip heater, and thereby controlling the temperature of the processing gases. In view of the fact that the thermal mass of the heater and sensor is minimal, the temperature can be rapidly and accurately controlled.

Thus, there has been provided an improved gas heater which can be easily installed in the supply lines for semiconductor processing equipment and which does not introduce impurities thereinto.

We claim:

1. A gas heater comprising a chamber defined by chamber walls having a gas inlet and a gas outlet;

a diversion plate in said chamber for increasing the heat exchange between said chamber walls and the gas flowing from said inlet to said outlet, said diversion plate separating said inlet and said outlet and having a solid portion directly opposite said inlet for diverting the gas flow entering said chamber toward said chamber wall between said inlet and said diversion plate and a perforated portion remote from said inlet for the flow of gas through said diversion plate from said inlet to said outlet; and a heater adjacent the exterior of the walls of said chamber for heating the walls of said chamber to thereby heat gas flowing in the chamber between the inlet and the outlet.

2. A gas heater as in claim 1 in which said chamber comprises two cup-shaped metal portions joined to said diversion plate.

3. A gas heater as in claim 1 in which said gas inlet and outlet are connected to fittings, whereby the heater can be installed in a processing gas line.

4. A gas heater as in claim 1 including a well shaped to receive a thermocouple extending into said gas outlet.

5. A gas heater as in claim 1 including a housing formed of a thermally insulating material enclosing said heater.

6. A gas heater as in claim 5 in which said housing includes two portions which are removable from said heater.

7. A gas heater comprising a chamber including two cup-shaped metal walls and a diversion plate with the rims of the cup-shaped walls welded to the diversion plate, said diversion plate having a solid portion and a perforated portion, a strip heater surrounding the chamber to heat the chamber walls, and a fitting welded to each of said cup-shaped metal walls for connecting the chamber in series with a processing gas line to cause the gas to flow through and be heated by the chamber walls, said diversion plate separating said fittings, said solid portion of said diversion plate being positioned directly opposite one of said fittings for diverting the gas How entering said chamber through said one of said fittings and said perforated portion being positioned remote from said one of said fittings for flow of the diverted gas through said diversion plate toward the other of said fittings.

8. A gas heater as in claim 7 including a housing formed of a thermally insulating material enclosing said chamber and said heater.

* * * * *